United States Patent [19]

Tomiyama

[11] Patent Number: 4,859,564

[45] Date of Patent: Aug. 22, 1989

[54] COLOR DIFFUSION TRANSFER PHOTOGRAPHIC ELEMENT WITH REDUCING SUGAR

[75] Inventor: Hideki Tomiyama, Kanagawa, Japan

[73] Assignee: Fuji Photo Film Co., Ltd., Kanagawa, Japan

[21] Appl. No.: 159,985

[22] Filed: Feb. 24, 1988

[30] Foreign Application Priority Data

Feb. 24, 1987 [JP] Japan ..... 62-39300

[51] Int. Cl.[4] ..... G03C 5/54

[52] U.S. Cl. ..... 430/216; 430/551

[58] Field of Search ..... 430/214, 216, 218, 551

[56] References Cited

U.S. PATENT DOCUMENTS

| | | | |
|---|---|---|---|
| 3,239,338 | 3/1966 | Rogers | 430/216 |
| 3,287,127 | 11/1966 | Dershowitz | 430/216 |
| 4,190,448 | 2/1980 | Sera et al. | 430/216 |

OTHER PUBLICATIONS

"Photographic Processes and Products" *Research Disclosure* No. 15162, 11/1978.

*Primary Examiner*—Richard L. Schilling

*Attorney, Agent, or Firm*—Sughrue, Mion, Zinn, Macpeak & Seas

[57] ABSTRACT

Disclosed is a color diffusion transfer photographic element having a neutralization system for lowering the pH value of an alkaline processing solution, wherein the said neutralization system contains a reducing sugar in an amount of from 0.1 to 20 mmol/m$^2$. The element may be a monosheet type element comprising a light-sensitive element and a cover sheet, and the neutralization system may be present either in the light-sensitive element or in the cover sheet. By the addition of the reducing sugar to the neutralization system, the image storability (light-fastness) under high temperature and high humidity conditions can be improved.

13 Claims, No Drawings

COLOR DIFFUSION TRANSFER PHOTOGRAPHIC ELEMENT WITH REDUCING SUGAR

FIELD OF THE INVENTION

The present invention relates to improvement of image storability of monosheet type color diffusion transfer photographs.

BACKGROUND OF THE INVENTION

In color diffusion transfer photography, a means of stabilizing an image that is formed by spreading an alkaline processing solution after exposure is known, in which the pH value of the image-forming system is lowered to about the neutral point (pH=7) after the image formation. In particular, this operation is important in so-called monosheet type color diffusion transfer photography, in which if the image formed is stored in a high pH system, the optical density of the highlight part would increase due to heat or moisture and the image quality would often be noticeably deteriorated thereby. This is because the non-reacted dye precursor (which is an alkaline compound capable of releasing a dye by redox reaction with the oxidation product of a developing agent) still existing in the light-sensitive layer is gradually oxidized by oxygen in the air to thereby release a dye. The reaction may proceed more easily in a higher pH system, and therefore, it is effective to lower the pH value in the system as much as possiblde so as to overcome such trouble. However, if the pH value of the system is too low, the dye as mordanted in the mordant layer is decomposed by light or oxygen and the image formed can even be lost in an extreme case. Accordingly, the improvement of image storability in a dark or light place under high temperature and high humidity could not be attained by only the pH adjustment of the photographic system during storage and any other means is being required therefor.

SUMMARY OF THE INVENTION

An object of the present invention is to improve the image storability in a monosheet type color diffusion transfer photographic element, in a dark or light place under high temperature and high humidity conditions.

The present inventors have extensively studied this matter and have found that the object of the present invention, which is to improve the image stability (lightfastness) in a color diffusion transfer photographic element having a neutralization system for lowering the pH value of the alkaline processing solution, in a dark or light place under high temperature and high humidity conditions, can effectively be attained by the incorporation of a reducing sugar into the neutralization system in an amount of from 0.1 to 20 mmol/$m^2$.

DETAILED DESCRIPTION OF THE INVENTION

The deterioration of the image or the extreme elevation of the density of the highlight part during storage for a long period of time in a dark place under high temperature and high humidity conditions is caused by the oxidation of the dye precursor, as mentioned above. Therefore, in one aspect, it would seem that the image storability could be improved by an addition of an antioxidant to the system. In addition, since the color fading (color fading by light) during storage for a long period of time in a light place is also caused by an oxidation reaction, viz., of the dye, it would be expected that the antioxidant might be effective for preventing or limiting color fading. It is a general practice to use a reducing agent as an antioxidant. However, the oxidation product itself would be colored to cause the elevation of the density of the highlight part or would react on the dye as mordanted in the mordant layer to cause the fading of the color of the dye, depending upon the kind of reducing agent. Therefore, the addition of the reducing agent would sometimes rather cause the deterioration of the image quality. Under the circumstances, the present inventors investigated numerous reducing agents to obtain compounds which are effective for improvement of the image storability without problems such as noted above, and at last have found that reducing sugars are most suitable for the intended purpose.

The reducing sugars are sugars having a free or hemiacetal type aldehyde or ketone groups and having a reducing function, which are known to be able to reduce a silver salt or copper salt Fehling's solution. In general, free monosaccharides are all reducing sugars, and some oligo-saccharides and polysaccharides may have a reducing function. More specifically, any reducing sugar described in F. Nishizawa, *Hydrocarbons* and R. L. Whistler and M. L. Wolfrom, *Methods in Carbohydrate Chemistry,* Vol 1, can suitably be used in the present invention. However, polysaccharides have a small proportion of the reducing group per the molecular weight and so these must be added in a large amount so as to attain the effect of the present invention. Accordingly, monosaccharides and oligosaccharides are preferred, and monosaccharides are most preferred for use in the present invention. The monosaccharides include, for example, ribose, deoxyribose, xylose, arabinose, galactose, arose, glucose (grape sugar), mannose, fructose (fruit sugar), sorbose, tagatose, fucose, rhamnose, mannoheptulose, sedoheptulose, talose, altrose, etc. The monosaccharides include optical isomers (D-form and L-form), and any of them can be used in the present invention. The oligosaccharides include, for example, maltose (malt sugar), lactose (milk sugar.), kojibiose, sophorose, nigerose, laminaribiose, cellobiose, isomaltose, gentiobiose, melibiose, planteobiose, turanose, vicianose, rutinose, manniontriose, verbascotetraose, maltotriose, xylotriose, panose, etc.

Assuming that it might be considered to add a reducing sugar to the light-sensitive layer or to the dye precursor-containing layer for the purpose of anti-oxidation of the dye precursor in the light-sensitive layer and the dye in the mordant layer, it would be noted that the addition of the reducing sugar to such position would exert a harmful influence on the storability prior to use of the photographic light-sensitive element (raw storability) and the photographic property of the element. This is because the reducing sugar may directly react on the light-sensitive silver halide emulsion or may participate in development or dye-releasing reaction during processing so that the photographic properties of the photographic element would be changed thereby. In this connection, it is to be noted that the reducing sugar must be active during storage after image formation for a long period of time, but in accordance with the present invention, this must not act during storage of the raw photographic element or during processing of the element. Accordingly, the reducing sugar must not be added to the light sensitive element, but is preferred to be added to a position which is apart from the light-sensitive element, so that it may be diffused into light-sensitive element after image formation in the element. More particularly, the position which may satisfy said condition is preferably the layer which participates in the neutralization of an alkaline processing solution. A neutralization system is provided so as to lower the pH value of the reaction system as processed to about a neutral point or so for the stabilization of the image formed, as mentioned above, and for attaining this purpose, a neutralizing layer and a neutralization-timing layer is generally combined in one system so that the alkaline processing solution may reach the neutralizing layer via the neutralization-timing layer. In such system, however, the neutralization-timing layer and the neutralizing layer may be same. The reducing sugar is preferably added to the neutralization timing layer or the neutralizing layer in the neutralization system, and by the addition of the reducing sugar, the image storability can be improved while the pre-exposure storability and the stability of the photographic properties can be ensured.

As the saccharides are unstable and are easily decomposed under an alkaline condition, it is unfavorable to add the saccharides to a layer with which an alkaline processing solution contacts directly. Even in view of such requirement, the neutralization system preferably contains the reducing sugar since the processing solution can be neutralized and penetrated thereinto. Most preferably, the reducing sugar is added to the neutralizing layer of the neutralization system.

The neutralization system can be provided either in the light-sensitive element or in the cover sheet which faces to the light-sensitive element, in the monosheet type color diffusion transfer photographic material, where the light-sensitive element and the cover sheet are combined via a determined space therebetween so that the alkaline processing solution can be spread into the space. When the neutralization system is provided in the light-sensitive element, this would sometimes be contacted directly with the light-sensitive layer, and so the reducing sugar of the present invention is preferably added to a layer which is separated from the light-sensitive layer by at least one other layer, such as a neutralization-timing layer, a mordant layer, etc. For example, when the neutralizing layer, neutralization-timing layer, and light sensitive layer are coated on the support in this order from the side of the support, the reducing sugar is desirably added rather to the neutralizing layer than to the neutralization-timing layer.

Although it is known that the neutralization system comprises a combination of a neutralizing layer and a neutralization-timing layer, the respective layers may be multilayers. For example, the system may be composed of a first neutralization-timing layer, a second neutralization-timing layer and a neutralizing layer, in this order from the uppermost layer; or alternatively, the system may have the layer constitution as illustrated in Japanese Patent Application (OPI) No. 19137/85 (the term "OPI" as used herein means a "published unexamined Japanese patent application"), which comprises a first neutralization-timing layer, an auxiliary neutralizing layer, a second neutralization-timing layer and a neutralizing layer. Although the reducing sugar may be added to any of the layers in the above described variations in the neutralization system, it is preferably added to the neutralizing layer or the auxiliary neutralizing layer.

For the neutralizing layer which constitutes the neutralization system of te photographic element of the present invention, a film-forming acid polymer is preferably used, and any acid polymer can be used for the neutralizing layer. Examples of acid polymers include a monobutyl ester of a copolymer of maleic anhydride and ethylene; a monobutyl ester of a copolymer of maleic anhydride and methyl vinyl ether; a monoethyl ester of a copolymer of maleic anhydride and ethylene, a monopropyl ester of said copolymer, a monopentyl ester of the copolymer, and a monohexyl ester of said copolymer; a monoethyl ester of a copolymer of maleic anhydride and methyl vinyl ether, a monopropyl ester of said copolymer, a monobenzyl ester of said copolymer, and a monohexyl ester of said copolymer; a polyacrylic acid; a polymethacrylic acid; copolymers of acrylic acid and methacrylic acid, in different proportions; copolymers of acrylic acid or methacrylic acid with other vinyl series monomers such as acrylic acid ester, methacrylic acid esters, vinyl ethers, acrylamides, methacrylamides, etc., in different proportions, preferably copolymers having acrylic or methacrylic acid content of from 50 to 90 mol %, etc. Neutralizing layers are described also in U.S. Pat. Nos. 3,362,819, 3,765,885 and 3,819,371, French Pat. No. 2,290,699, etc. In particular, the use of polyacrylic acids and acrylic acid-butyl acrylate copoymers for the neutralizing layer is effective.

For the neutralization-timing layer which is to be used in combination with the neutralizing layer, a gelatin, a polyvinyl alcohol, a polyacrylamide, a partially hydrolyzed polyvinyl acetate, a $\beta$-hydroxyethyl methacrylate ethyl acrylate copolymer, an acetyl cellulose, etc., can be used as the main component. In addition, the components described in U.S. Pat. Nos. 3,455,686, 3,421,893, 3,785,815, 3,847,615 and 4,009,030, Japanese Patent Application (OPI) No. 14415/77, etc., can also be used. A polymer layer having a noticeable temperature dependence on the alkaline processing solution permeability therethrough, which is described, for example, in U.S. Pat. Nos. 4,056,394 and 4,061,496, Japanese Patent Application (OPI) Nos. 72622/78 and 78130/79, etc., can be combined with the above-mentioned neutralization-timing layer.

Further, polymer products of monomers capable of being $\beta$-released under an alkaline condition can be utilized for the neutralization-timing layer in the photo graphic element ff the present invention, and examples of such polymer products are described, for example, in Japanese Patent Application (OPI) No. 19137/85, U.S. Pat. Nos. 4,297,431, 4,288,523, 4,201,587 and 4,229,516, Japanese Patent Application (OPI) Nos. 121438/80, 166212/81, 41490/80, 54341/80, 102852/81, 141644/82, 173834/82, 179841/82 and 202463/84, West German Patent Application (OLS) No. 2,910,271, European Patent Publication EP No. 3195Al, Research Disclosure, RD No. 18452 (August, 1979), etc.

Also, latex polymers can be used, and, examples thereof include the polymer latex film described in *Research Disclosure,* RD No. 15162 (November, 1976), U.S. Pat. No. 4,056,394, Japanese Patent Application (OPI) No. 72622/78, etc. Examples of the polymer latexes include a ternary copolymer of methylacrylate-itaconic acid-vinylidene chloride; a ternary copolymer of acrylonitrile-acrylic acid-vinylidene chloride; a ternary copolymer of styrene-butyl acrylate-acrylic acid; a ternary copolymer of methyl acrylate-acrylic acid-vinylidene chloride; a quaternary copolymer of styrene-butyl acrylate-acrylic acid-N-methylol acrylamide; a ternary copolymer of methyl methacrylate-acrylic acid-N-methylol acrylamide, etc. The mean grain size of these latexes is generally from about 0.05 to 0.4 μm, and preferably from 0.1 to 0.2μm. The acid monomer content is preferably from 2 to 10 mol %.

For the reproduction of a natural color by substractive color process, a photographic light-sensitive material at least comprising the two elements of a silver halide emulsion having a selective spectral sensitivity in a certain wavelength range and a color image-forming compound (hereinafter referred to as a "coloring material") capable of forming a color image which has a selective spectral absorption in that wavelength range (or a coloring material containing a group capable of forming a dye of such color image) is used.

When the photographic element of the present invention is a photographic light-sensitive material or a film unit, the element particularly advantageously contains a combination of a blue-sensitive silver halide emulsion and an yellow coloring (color-forming) material, a combination of a green-sensitive emulsion and a magenta coloring material and a combination of a red-sensitive emulsion and a cyan coloring material. The foregoing combinations comprising the emulsion and the said coloring material can be integrated in the photographic light-sensitive material in the form of a face-to-face multilayer constitution, or, alternatively, can be blended in the form of the respective grains (where both the coloring material and the silver halide components exist in the same grain) and the mixture of the grains can be coated on a support as one layer.

Next, a coloring material capable of releasing a diffusive dye for the formation of a transferred image is explained, as one example.

The coloring material which is preferably used in the present invention is substantially nondiffusible under an alkaline processing condition and is a DRR (dye-redox-releasing) compound which is generally represented by the following general formula (I):

(Ballast)—(Redox Releasing Atomic Group)—(Dye) (I)

in which (Ballast) represents a group for rendering substantially nondiffusible the compound under an alkaline processing condition, but if the compound is substantially nondiffusible in the presence of only the remaining groups, i.e., (Redox releasing Atomic Group-)—(Dye), the (Ballast) group is unnecessary;

(Dye) represents a dye group which is mobile at least under an alkaline processing condition when released from the compound, or a precursor thereof; and (Redox Releasing Atomic Group) represents a group which may be cleaved by oxidation under the alkaline processing condition.

An especially useful coloring material for the present invention is a negatived working DRR compound capable of releasing a dye by the alkaline oxidation. In addition, a coupler capable of releasing a diffusive dye (for example, the compounds described in U.S. Pat. No. 3,227,550, etc.) and color developing agents can also be used.

In the photographic emulsion for use in the present invention, anyone of silver bromide, silver iodobromide, silver iodochlorobromide, silver chlorobromide, and silver chloride can be used as a silver halide. Preferred silver halides are silver bromide, silver iodobromide, and silver iodochlorobromide having an iodide content of 20 mol % or less and a chloride content cf 30 mol % or less. An especially preferred silver halide is silver bromide.

The silver halide emulsion is an internal latent image type emulsion which forms a latent image mainly in the inside of the silver halide grains, and a direct reversal photographic emulsion which can directly form a positive image by the presence of a nucleating agent is preferred.

When the photographic element of the present invention is an image-receiving material or a film unit, the image-receiving element of the photographic element at least contains a mordant layer (image-receiving layer), and the mordant layer preferably comprises a polyemric mordant agent. Examples of the polyemric mordant agents include secondary or tertiary amino group-containing polymers, nitrogen-containing heterocyclic moiety-containing polymers and the corresponding quaternary cation group-containing polymers, which have a molecular weight of 5,000 or more, and especially preferably 10,000 or more.

The processing composition to be used for processing the photographic light-sensitive material of the present invention suitably contains a base such as sodium hydroxide, potassium hydroxide, sodium carbonate, or sodium phosphate and has a pH value of about 9 or more, and preferably has an alkali strength of pH 11.5 or more. The processing composition can contain an antioxidant such as sodium sulfite, an ascorbic acid salt or piperidinohexose reductone. It may further contain a silver ion concentration adjusting agent such as potassium bromide. Moreover, it may also contain a viscosity-increasing compound such as hydroxyethyl cellulose or sodium carboxymethyl cellulose.

The alkaline processing composition for use in the present invention can also contained a compound having an activity of development acceleration, or an activity of dye diffusion acceleration. For example, the composition may contain benzyl alcohol for said purpose. The developing agent can be incorporated into the processing solution or at least a part thereof can be incorporated into a pertinent layer (such as silver halide emulsion layer, coloring material-containing layer, interlayer, image-receiving layer, etc.) of the photographic light-sensitive material (or film unit) to be processed.

Examples of the developing agents include hdyroquinone compounds such as hydroquinone, 2,5-dichlorohydroquinone and 2-chlorohydroquinone; aminophenol compounds such as 4-aminophenol, N-methylaminophenol, 3-methyl-4-aminophenol and 3,5-dibromoaminophenol; catechol compounds such as catechol, 4-cyclohexylcatechol, 3-methoxycatechol and 4-(N-octadecylamino)catechol; phenylenediamine compounds such as N,N-diethyl-p-phenylenediamine, 3-methyl-N,N-diethyl-p-phenylenediamine, 3-methoxy-N-ethyl-N-ethoxy-p-phenylenediamine and N,N,N',N'-tetramethyl-p-phenenediamine; 3-pyrazolidone compounds such as 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-4-methyl-4-hydroxymethyl 3-pyrazolidone, 1-phenyl-4-methyl-3-pyrazolidone, lk-phenyl-5-methyl-3-pyrazolidone, 1-phenyl 4,4-bis-(hydroxymethyl)-3-0pyrazolidone, 1,4-di-methyl-3-pyrazolidone, 4-methyl-3-pyrazolidone, 4,4-dimethyl 3-pyrazolidone, 1-(m-chlorophenyl)-4-methyl-3pyrazolidone, 1-(p-chlorophenyl) 4-methyl-3-pyrazolidone, 1-(m-chlorophenyl)-3-pyrazolidone, 1-(p-chlorophenyl)-3pyrazolidone, 1-(p-tolyl)-4-methyl-3-pyrazolidone, 1-(o-tolyl)-4-methyl-3-pyrazolidone, 1-(p-tolyl)-3-pyrazolidone, 1-(m-tolyl)-4,4-dimethyl-3-pyrazolidone, 1-(2-trifluoroethyl) 4,4-dimethyl-3-pyrazolidone and 5-methyl-3pyrazolidone, etc. In particular, 3-pyrazolidone compounds are especially preferred among them.

The developing agents can be used in combination of various kinds of the agents, as described in U.S. Pat. No. 3,039,869.

The following examples are intended to illustrate the present invention, but not to limit it in any way.

EXAMPLE 1

Cover Sheet:

A comparative cover sheet (i) was prepared by forming the following layers (1) to (4) on a transparent polyethylene terephthalate in the order listed (1) Neutralizing layer formed by coating 9 g/m$^2$ of acrylic acid/butyl acrylate (8/2, by weight) copolymer having a mean molecular weight of 50,000 and 0.18 g/m$^2$ of 1,4-bis(2,3-epoxypropoxy)-butane. (2) Second timing layer formed by coating 7.5 g/m$^2$ of cellulose acetate having an acetylation degree of 51.0% and methyl vinyl ether/-monomethyl maleate alternating copolymer in a weight ratio of 95/5 and 0.825 mmol/m$^2$ of 1,3-bis[2-(1-phenyl-5-tetrazolylthio)ethylsulfonyl]-2 propanol. (3) Auxiliary neutralizing layer formed by coating 0.735 g/m$^2$ of methyl vinyl ether/maleic anhydride alternating copolymer, 0.315 g/m$^2$ of styrene/maleic acid alternate copolymer and 0.45 g/m$^2$ of cellulose acetate having an acetylation degree of 55.0%. (4) First timing layer formed by coating a polymer latex blend comprising a polymer latex formed by emulsion polymerization of styrene/butyl acrylate /acrylic acid/N-methylol acrylamide in a weight ratio of 49.7/42.3/4/4 and a polymer latex formed by emulsion polymerization of methyl methacrylate/acrylic acid/N-methylol acrylamide in a weight ratio of 93/3/4, the solid ratio of the former polymer latex to the latter polymer latex being 6/4, and th®total solid weight of the blend coated being 1.6 g/m$^2$.

Next, cover sheets (i) to (x) of the present invention were prepared in the same manner as the abovementioned comparative cover sheet, except that the reducing sugars shown in Table 1 below were respectively added to the neutralizing layer.

TABLE 1

| Cover Sheet | Reducing Sugar | Amount Added (mmol/m$^2$) |
|---|---|---|
| (i) | D-glucose | 0.5 |
| (ii) | D-glucose | 5.0 |
| (iii) | D-glucose | 10.0 |
| (iv) | D-glucose | 20.0 |
| (v) | D-galactose | 5.0 |
| (vi) | D-fructose | 5.0 |
| (vii) | D-mannose | 5.0 |
| (viii) | D-arabinose | 5.0 |
| (ix) | Maltose | 10.0 |
| (x) | Lactose | 10.0 |

Light-sensitive Sheet:

A light-sensitive sheet was prepared by forming the following layers on a transparent polyethylene terephthalate sheet.

(1) Mordant layer containing 3.0 g/m$^2$ of gelatin and 3.0 g/m$^2$ of the following polymeric latex mordant agent.

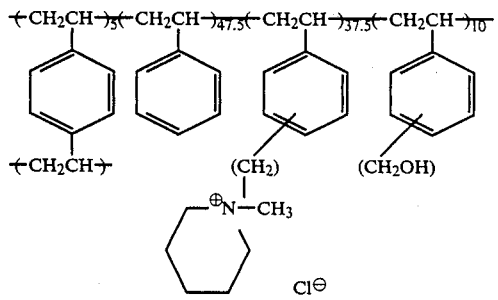

(2) White reflective layer containing 18 g/m$^2$ of titanium dioxide and 2.0 g/m$^2$ of gelatin. (3) Light-shielding layer containing 2.0 g/m$^2$ of carbon black and 1.0 g/m$^2$ of gelatin. (4) Layer containing 0.44 g/m$^2$ of the following cyan dye-releasing redox compound, 0.09 g/m$^2$ of tricyclohexyl phosphate, 0.008 g/m$^2$ of 2,5-di-t-pentadecyl hydroquinone and 0.8 g/m$^2$ of gelatin.

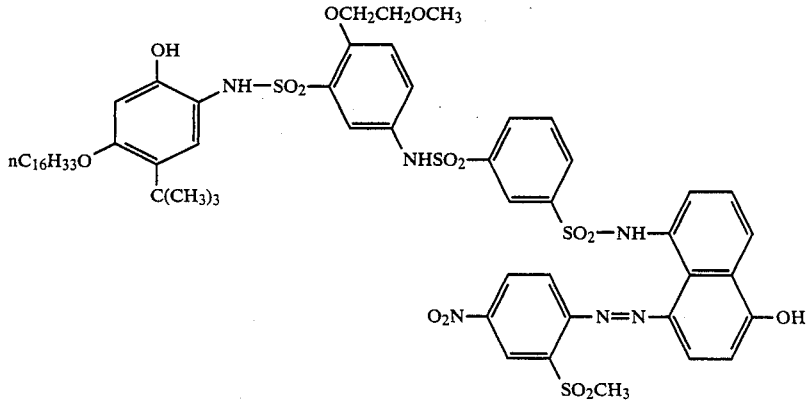

(5) Layer containing 1.5 g/m$^2$ of titanium dioxide and 0.40 g/m2 of gelatin.

(6) Red-sensitive emulsion layer containing 1.03 g/m$^2$ (as silver) of a red-sensitive internal latent image-type direct positive silver bromide emulsion, 1.2 g/m$^2$ of gelatin, 0.04 mg/m$^2$ of the following nucleating agent and 0.13 g/m$^2$ of 2-sulfo-5-n-pentadecylhydroquinone sodium salt.

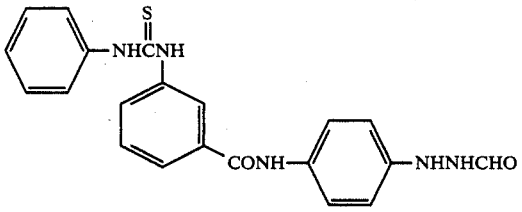

(7) Layer containing 0.43g/m$^2$ of 2,5-di-t-pentadecylhydroquinone, 0.1 g/m$^2$ of polymethyl methacrylate and 0.4 g/m$^2$ of gelatin.

(8) Layer containing 0.3 g/m$^2$ of the following magenta dye-releasing redox compound, 0.08 g/m$^2$ of tricyclohexyl phosphate, 0.009 g/m$^2$ of 2,5-di-tert-pentadecylhydroquinone and 0.5 g/m$^2$ of gelatin.

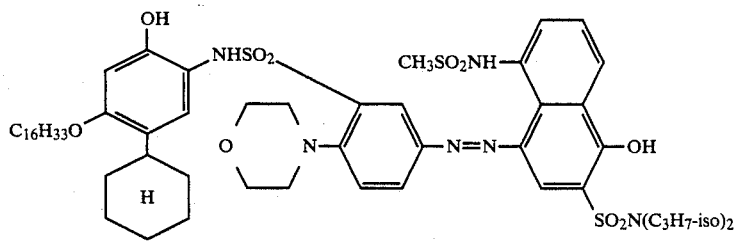

(9) Layer containing 0.8 g/m$^2$ of titanium dioxide, 0.25 g/m$^2$ of gelatin and 0.05 g/m$^2$ of the following compound.

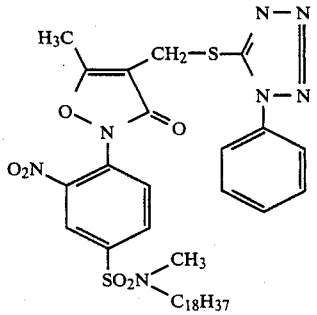

(10) Green-sensitive emulsion layer containing 0.82 g/m$^2$ (as silver) of a green-sensitive internal latent image-type direct positive silver bromide emulsion, 0.9 g/m$^2$ of gelatin, 0.03mg/m$^2$ of the same nucleating agent as Layer (5) and 0.08 g/m$^2$ of 2-sulfo-5-n-pentadecylhydroquinone sodium salt.

(11) Same as Layer(7)

(12) Layer containing 0.5 g/m$^2$ of the following yellow dye-releasing redox compound, 0.13 g/m$^2$ of tricyclohexyl phosphate and 0.5 g/m$^2$ of gelatin.

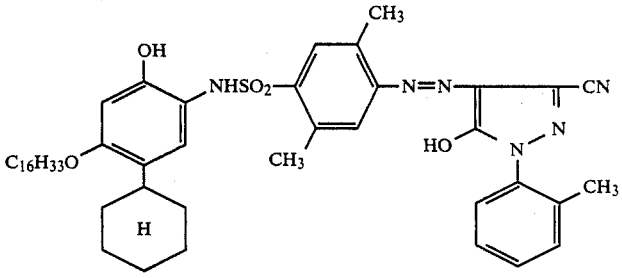

(13) Layer containing 0.23 g/m$^2$ of gelatin.

(14) Blue-sensitive emulsion layer containing 1.09 g/m$^2$ (as silver) of a blue-sensitive internal latent image-type direct positive silver bromide emulsion, 0.04 mg/m$^2$ of the same nucleating agent as Layer (5) and 0.07 g/m$^2$ of 2-sulfo-5-n-pentadecylhydroquinone sodium salt.

(15) Layer containing the following Ultraviolet 3 Absorbers (A) and (B) each in an amount of $4.0\times10^{-4}$ mol/m$^2$, 0.08 g/m$^2$ of the following Antifoggant (A), 0.05 g/m$^2$ of 2,5-di-tert-pentadecylhydroquinone and 0.10 g/m$^2$ of polymethyl methacrylate.

Ultraviolet Absorber (A):

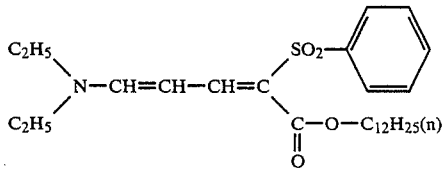

Ultraviolet Absorber (B):

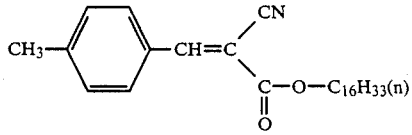

Antifoggant (A):

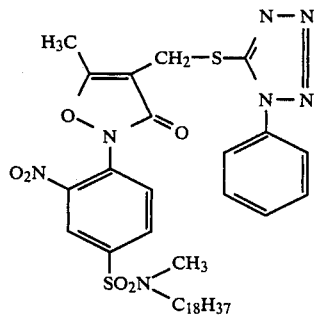

(16) Protective layer containing 0.10 g/m$^2$ of polymethyl methacrylate latex (mean grain size, 4 μm), 0.8 g/m$^2$ of gelatin and 0.02 g/m$^2$ of triacryloyl triazine as a hardener.

Composition of Processing Solution:

| | |
|---|---|
| 1-p-tolyl-4-hydroxymethyl-4-methyl-3-pyrazolidone | 14.0 g |
| Sodium t-butylhydroquinonesulfonate | 0.3 g |
| 5-Methylbenzotriazole | 3.5 g |
| Sodium Sulfite (Anhydride) | 0.2 g |
| Sodium Carboxymethyl Cellulose | 58 g |
| Potassium Hydroxide (28 wt. % aqueous solution) | 200 cc |
| Benzyl Alcohol | 1.5 cc |
| Carbon Black | 150 g |
| Water | 685 cc |

The light-sensitive sheet was exposed through a continuous wedge and then this was stacked to each of the comparative cover sheet and the cover sheets of the present invention as prepared above, in such manner that the coated surfaces of the sheets faced to each other. The processing solution mentioned above was spread between the two sheets thus stacked by passing through a pair of pressure rollers. One hour after the solution was spread, the density of the image formed was measured with respect to the minimum density part (Dmin) of each of red(R), green(G) and blue(B). Next, the samples were stored for 3 weeks under the conditions of 60° C. and 70% RH, and then the minimum density Dmin was again measured. The difference ($\Delta D_{min}$) between the value of $D_{min}$ ontained in one hour after the spreading the processing solution and that obtained after the storage for 3 weeks under the condition of 60° C. and 70% RH was calculated. The results obtained are shown in Table 2 below. The small $\Delta D_{min}$ value means that the increment of the minimum density after the storage for 3 weeks under the condition of 60° C. and 70% RH is small, and the smaller, the better.

TABLE 2

| Cover Sheet No. | $\Delta D_{min}$ | $\Delta D_{min}$ | $\Delta D_{min}$ |
|---|---|---|---|
| Comparison | 0.234 | 0.115 | 0.480 |
| Invention (i) | 0.196 | 0.105 | 0.421 |
| Invention (ii) | 0.102 | 0.092 | 0.303 |
| Invention (iii) | 0.095 | 0.090 | 0.289 |
| Invention (iv) | 0.094 | 0.090 | 0.273 |
| Invention (v) | 0.110 | 0.092 | 0.314 |
| Invention (vi) | 0.103 | 0.092 | 0.305 |
| Invention (vii) | 0.103 | 0.092 | 0.304 |
| Invention (viii) | 0.102 | 0.092 | 0.303 |
| Invention (ix) | 0.153 | 0.099 | 0.355 |

TABLE 2-continued

| Cover Sheet No. | $\Delta D_{min}$ | $\Delta D_{min}$ | $\Delta D_{min}$ |
|---|---|---|---|
| Invention (x) | 0.157 | 0.100 | 0.361 |

$\Delta D_{min}$ = $D_{min}$ (after stored for 3 weeks at 60° C. and 70% RH) - $D_{min}$ (one hour after spreading of the processing solution)

The results of Tale 2 indicate the improvement of the image storability (increment of $D_{min}$) under high temperataure and high moisture conditions due to the addition of the reducing sugar to the neutralizing layer. In particular, the effect was shown remarkable in the parts of $D_{min}$ and $D_{min}$ where the increment of $D_{min}$ is generally large. Although all the reducing sugars tested were effective, the monosaccharides were especially effective among them.

EXAMPLE 2

With respect to the samples of Example 1, the difference $\Delta D_{min}$ between the magenta maximum density $D_{max}$ obtained in one hour after the spreading of the processing solution and that obtained after the storage for 3 weeks under the conditions of 60° C. and 70% RH was calculated. The results obtained are shown in Table 3 below.

TABLE 3

| Cover Sheet No. | $\Delta D_{max}$ |
|---|---|
| Comparison | 0.125 |
| Invention (i) | 0.113 |
| Invention (ii) | 0.042 |
| Invention (iii) | 0.022 |
| Invention (iv) | 0.003 |
| Invention (v) | 0.042 |
| Invention (vi) | 0.041 |
| Invention (vii) | 0.039 |
| Invention (viii) | 0.045 |
| Invention (ix) | 0.061 |
| Invention (x) | 0.058 |

$\Delta D_{max}$ = (one hour after spreading the processing solution) - $D_{max}$ (after stored for 3 weeks at 60° C. and 70% RH)

When the image was stored under high temperature and high humidity, the magenta color was apt to be faded, and the degree of the fading was noticeable in the comparative sample, However, the degree of the fading was remarkably reduced in the samples of the present invention. Thus, the results of Table 3 indicate that the addition of the reducing sugar is effective also for the storability of the magenta dye.

EXAMPLE 3

The light-sensitive sheet as prepared in Example 1 was exposed and processed with the processing solution in the same manner as in Example 1. One side of each of the thus processed samples was shielded from light with a paper and the samples were put in a 17,000 lux fluorescent fade meter apparatus and kept therein for 4 weeks. After the fading test, the density of the light-irradiated part and that of the light-shielded part were measured. The difference in the density between the light-irradiated part and the light-shielded part (by application of the light-shielding paper) was obtained so as to measure the degree of the color fading by light. As specific values, the difference in the maximum magenta density ($\Delta D_{max}$) and the density difference in the cyan gradation part (density 1.0) ($\Delta D_{1.0}$) are shown in Table 4 below. Smaller values of $\Delta D_{max}$ and $\Delta D_{1.0}$ mean better light-shieldability.

TABLE 4

| Cover Sheet No. | $\Delta D_{max}$ | $\Delta D_{1.0}$ |
|---|---|---|
| Comparison | 0.476 | 0.235 |
| Invention (i) | 0.423 | 0.220 |
| Invention (ii) | 0.240 | 0.186 |
| Invention (iii) | 0.024 | 0.181 |
| Invention (iv) | 0.005 | 0.175 |
| Invention (v) | 0.243 | 0.186 |
| Invention (vi) | 0.261 | 0.188 |
| Invention (vii) | 0.232 | 0.187 |
| Invention (viii) | 0.228 | 0.184 |
| Invention (ix) | 0.307 | 0.199 |
| Invention (x) | 0.312 | 0.196 |

$\Delta D$ = D (light-shielded part) - D (lightirradiated part)

The results of Table 4 indicate that the light-fastness of the images of the present invention is extremely good. In particular, these show that the reducing sugars are effective to the magenta color ($D_{max}$) which may often be faded by oxidation and the reducing sugars act as an antioxidant for color images.

EXAMPLE 4

A comparative cover sheet was prepared in the same manner as the preparation of the comparative cover sheet of Example 1, except that the neutralizing layer was replaced by a neutralizing layer formed by coating 6.2 g/m$^2$ of an acrylic acid polymer (Juryme AC-10L, by Nihon Junyaku Co., Ltd.), 6.2 g/m$^2$ of a polyvinyl alcohol (PVA205, by Kuraray) and 0.124 g/m$^2$ of 1,4-bis(2,3 epoxypropoxy)butane.

In addition, cover sheets of the present invention were also prepared in the same manner as the preparation of the comparative cover sheet of Example 4, except that the reducing sugar as shown in Table 1 was added to the above-mentioned neutralizing layer.

These cover sheets were tested in the same manner as in Examples 1, 2 and 3, and, as a result, the image storability (both light storability and dark storability) of the samples of the present invention was determined to be better than that of the comparative sample in every test.

According to the present invention, the image storability in a dark place and a light place under high temperature and high humidity can be unexpectedly improved.

While the invention has been described in detail and with reference to the specific embodiments thereof, it will be apparent to one skilled in the art that various changes and modifications can be made therein without departing from the spirit and scope thereof.

What is claimed is:

1. A color diffusion transfer photographic element having at least one silver halide emulsion layer, a dye image forming material, a dye mordant image receiving layer and a neutralization system for lowering the pH value of an alkaline processing solution, wherein said neutralization system contains a reducing sugar in an amount of from 0.1 to 20 mmol/m$^2$.

2. A color diffusion transfer photographic element as in claim 1, wherein the reducing sugar is selected from monosaccharides and oligosaccharides.

3. A color diffusion transfer photographic element as in claim 1, wherein the reducing sugar is selected from monosaccharides.

4. A color diffusion transfer photographic element as in claim 1, wherein the reducing sugar is added to a neutralization-timing layer or a neutralizing layer in the neutralization system.

5. A color diffusion photographic element as in claim 1, wherein the reducing sugar is added to a neutralizing layer in the neutralization system.

6. A color diffusion transfer photographic element as in claim 1, which is a monosheet type element comprising a light-sensitive element and a cover sheet, with an alkaline processing solution introduced therebetween.

7. A color diffusion transfer photographic element as in claim 6, wherein the neutralization system is present in the light-sensitive element.

8. A color diffusion transfer photographic element as in claim 6, wherein the neutralization system is present in the cover sheet.

9. A color diffusion transfer photographic element as in claim 2, wherein the reducing sugar is added to a neutralizing layer in the neutralization system.

10. A color diffusion transfer photographic element as in claim 3, wherein the reducing sugar is added to a neutralizing layer in the neutralization system.

11. A color diffusion transfer photographic element as in claim 2, which is a monosheet type element comprising a light-sensitive element and a cover sheet, with an alkaline processing solution introduced therebetween.

12. A color diffusion transfer photographic element as in claim 3, which is a monosheet type element comprising a light-sensitive element and a cover sheet, with an alkaline processing solution introduced therebetween.

13. A color diffusion transfer photographic element as in claim 4, which is a monosheet type element comprising a light-sensitive element and a cover sheet, with an alkaline processing solution introduced therebetween.

* * * * *